US006475037B1

(12) United States Patent
Harting et al.

(10) Patent No.: US 6,475,037 B1
(45) Date of Patent: Nov. 5, 2002

(54) CONTACT ELEMENT MADE OF SHEET-METAL MATERIAL

(75) Inventors: Dietmar Harting, Espelkamp (DE); Jens Krause, Rahden (DE); Ludger Leve, Espelkamp (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/557,066

(22) Filed: Apr. 21, 2000

(30) Foreign Application Priority Data

Apr. 30, 1999 (DE) ..... 199 19 854
Oct. 14, 1999 (DE) ..... 199 49 535

(51) Int. Cl.[7] ..... H01R 13/434
(52) U.S. Cl. ..... 439/745; 439/871; 439/843
(58) Field of Search ..... 439/745, 843, 439/851, 852, 871, 271, 272, 274, 742, 743, 825–827

(56) References Cited

U.S. PATENT DOCUMENTS 2,486,285 A * 10/1949 Hurst ..... 439/745
3,544,954 A 12/1970 Yeager
3,894,785 A * 7/1975 Hubner et al. ..... 439/825
5,209,680 A * 5/1993 Fry ..... 439/825
5,397,253 A 3/1995 Fries
5,449,304 A * 9/1995 Huss, Jr. et al. ..... 439/825
5,518,420 A * 5/1996 Pitschi ..... 439/825
5,599,212 A * 2/1997 Sawada ..... 439/843
5,873,754 A * 2/1999 Hotea ..... 439/843
5,951,337 A * 9/1999 Brake ..... 439/825

FOREIGN PATENT DOCUMENTS

DE 16 40 753 A1 11/1970
DE 44 32 921 A1 3/1995

* cited by examiner

*Primary Examiner*—Tho D. Ta
(74) *Attorney, Agent, or Firm*—Cook, Alex, McFarron, Manzo, Cummings & Mehler, Ltd.

(57) ABSTRACT

For transmitting high currents, such as in the electrical system of a motor vehicle for example, a contact element is proposed which is rolled and stamped from sheet-metal material and which consists of a contact-making section, a conductor-connecting section and a fastening section with an overlapping sleeve. In the contact element, the sleeve is at a radial distance from the fastening section.

15 Claims, 4 Drawing Sheets

CONTACT ELEMENT MADE OF SHEET-METAL MATERIAL

The invention relates to a contact element made of stamped and rolled sheet-metal material and having a contact-making section, a conductor-connecting section, and a fastening section for fastening the contact element in a receiving chamber in an insulating body.

Contact elements of this kind are used in order, for example, to pass on currents from a current source to the consumer in the electrical system of a motor vehicle.

It is known practice, in the automotive engineering field, to use contact elements, which are produced as stamped bending contacts, for transmitting currents. However, this is only possible in the case of relatively low current intensities, since major heating-up of the contact material and, in particular, of the fastening material occurs in the case of high currents.

The underlying object of this invention is therefore to construct a contact element of the initially mentioned type in such a way that the transmission of high current intensities is ensured and the heating-up of the contact elements and fastening material is reduced to a minimum.

SUMMARY OF THE INVENTION

The object of this invention is achieved through the fact that there is pushed on, over the fastening section of the contact element, a sleeve which is at a radial distance from the said fastening section.

Advantageous refinements are indicated in claims 2 to 10.

The advantages obtained with the aid of the invention consist, in particular, in the fact that, because of the radial distance of an overlapping sleeve on the fastening section of the contact element, only moderate transmission of heat to the material of the receiving chamber in the insulating body occurs. Under these circumstances, constant dissipation of heat is obtained as a result of the permanent circulation of air through the cavities in the contact elements which are stamped and shaped from sheet-metal material.

Further advantages of the invention lie in the fact that the plugging-in forces of the pin contact have gentle resilience during the initial plugging-in operation and a heightened spring tension is present during the rest of the plugging-in operation, the spring characteristic having a progressive development.

Furthermore, components produced in this way represent a cost-effective alternative to solid contact elements.

An exemplified embodiment is represented in the drawings and will be explained in greater detail below. In the said drawings:

DETAILED DESCRIPTION OF THE INVENTION

Figure 1:
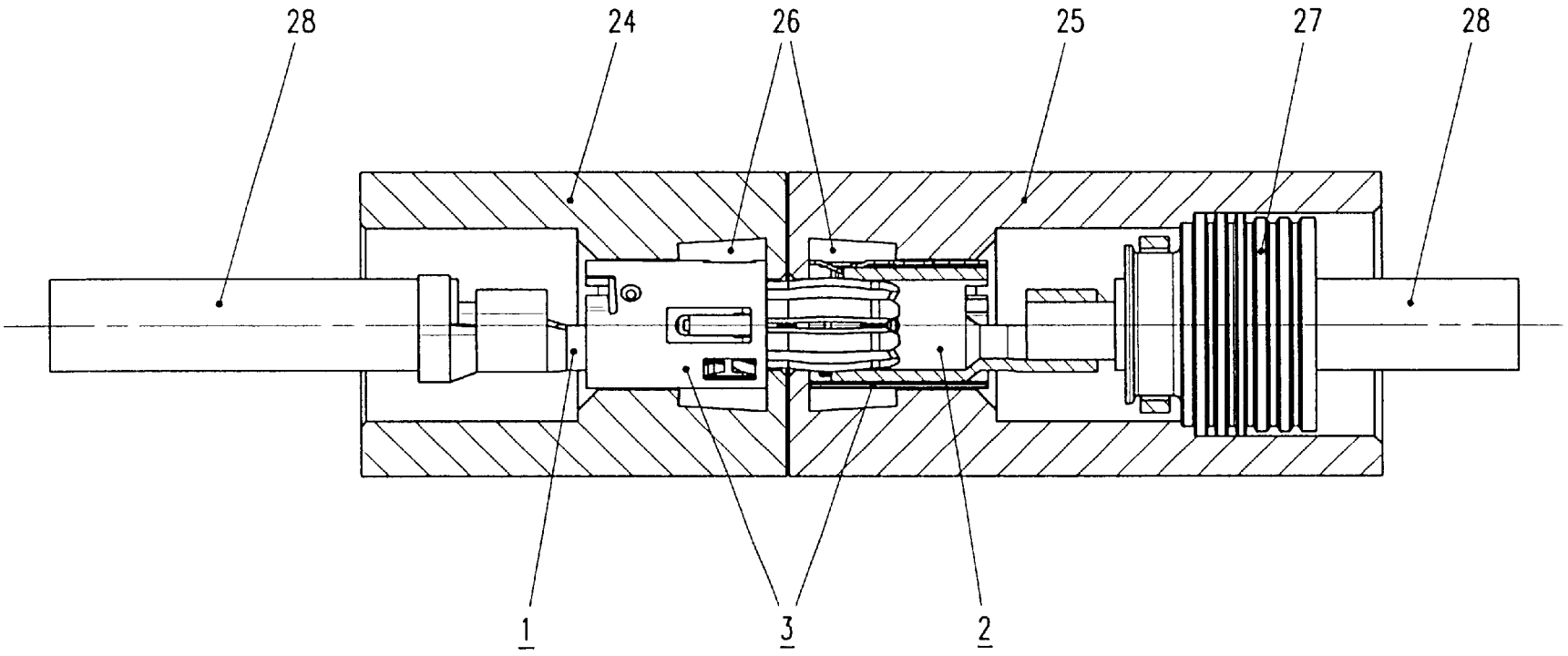
FIG. 1 shows a combined section and side view of two contact elements, which have been plugged together, in their receiving housings.

Represented in FIG. 1, in a combined sectional and side view, are two contact elements which are plugged together, consist of a pin contact 1 and a socket contact 2 with an overlapping sleeve 3 in each case, and are inserted in their respective receiving housings 24 and 25. Locking chambers 26, in which the contact elements are arrested, are provided in the receiving housings.

Electrical conductors 28 are attached to the contact elements in each case, the contact element of the socket contact 2 being provided with a sealing sleeve 27 in order to protect this connection against contamination from outside.

Figure 2:
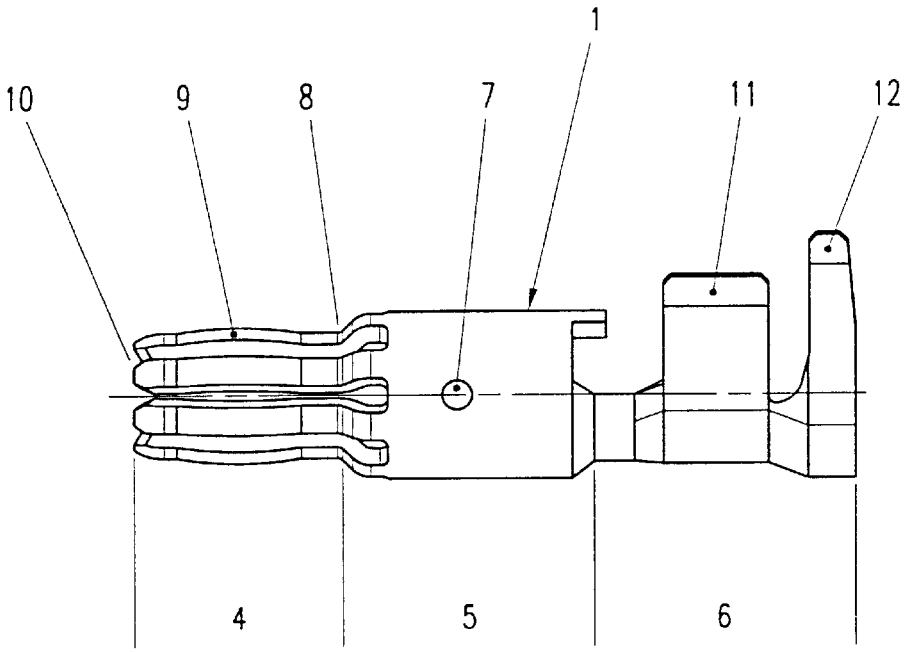
FIG. 2 shows a side view of a pin contact.

A contact element constructed as a pin contact 1 is represented in FIG. 2 in a side view.

The contact element is subdivided into three regions: a contact-making section 4, a fastening section 5 and a conductor-connecting section 6, the sleeve 3 being positioned over the fastening section 5 in each case. The tubular fastening section 5 is provided with bores or clearances 7 in order to prevent twisting of the sleeve 3 on the fastening section in which the hook-shaped, inwardly pointing ends 17 of the spring flaps 15 engage at that point.

Immediately adjoining the fastening section, via a constricted portion 8, is the contact-making section 4, which is bent in a spherical or barrel-shaped manner and is formed from contact tongues 9, of the pin contact 1 which is reduced in its diameter compared with the fastening section, so that the contact-making section of the pin contact 1 can be pushed into the contact-making section of the socket contact 2. The contact tongues 9 of the contact-making section are separated from one another by slits 10. Under these circumstances, provision is made for the slits 10 to reach beyond the contact-making section 4 and right into the fastening section 5.

The spring properties of the contact tongues can be varied and adapted to the desired requirements, by the length of the slits and also by the shape of the contact tongues between the fastening section 5 and the constricted portion 8.

The connection of an electrical conductor takes place via crimping flaps 11 for the strands which have been stripped of insulation, and also with the aid of fastening flaps 12 for holding the sheath of the cable.

Figure 3:
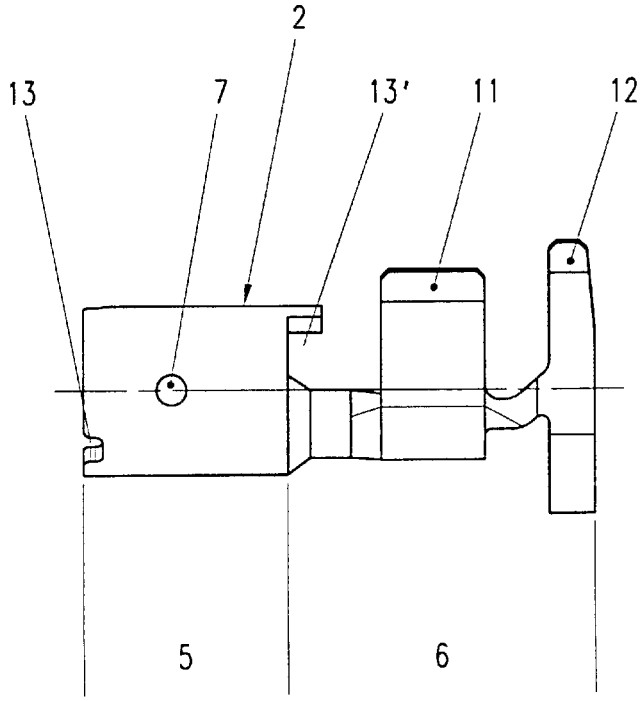
FIG. 3 shows a side view of a socket contact.

The contact element which is constructed as a socket contact 2 is represented in FIG. 3 in a side view.

In this case, the tubular contact-making section 4 at the same time forms the fastening section 5 for the sleeve 3. Adjoining this is the conductor-connecting region 6 which is constructed as a crimping-type connection for the purpose of receiving and fastening an electrical cable.

In the fastening section 5, there are likewise provided, as in the case of the pin contact, bores 7 for the hook-shaped ends 17 of the spring flaps 15, which bores prevent twisting of the sleeve on the said fastening section. Furthermore, stamped-out portions 13' into which the arresting flaps 21 and 22 of the sleeve 3 are bent inwards, are provided on either side of the fastening section, as shown in FIG. 3 so that displacement of the sleeve in the axial direction is prevented.

Figure 4A:
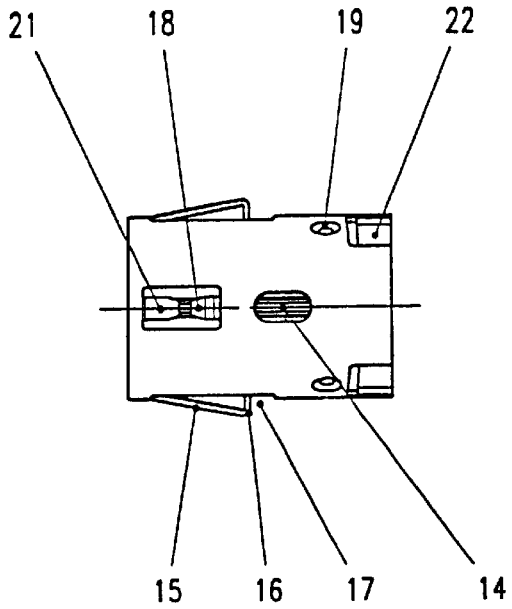
FIG. 4A shows a side view of a sleeve.
Figure 4B:
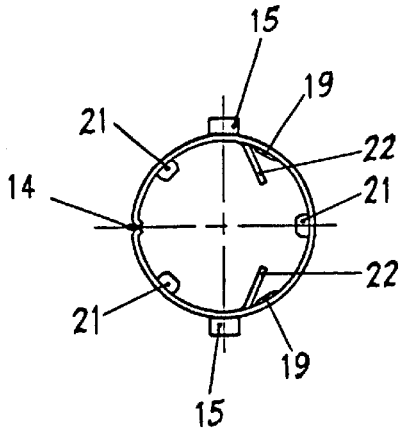
FIG. 4B shows a left side view of the sleeve shown in FIG. 4A.

The sleeve 3, which is stamped from sheet-metal material and bent in the form of a tube, is represented in FIG. 4 in a side view.

Under these circumstances, the sheet-metal ends of the sleeve are bent inwards at the seam point 14 in such a way that the seam point ensures, as a supporting web, a minimum distance between the sleeve 3 and the fastening section 5. In addition, inwardly pointing distance flaps 18, and also inwardly directed impressed portions 19 are provided on the sleeve as further spacer elements.

On opposite sides of the sleeve 3, outwardly bent spring flaps 15 with inwardly pointing, hook-shaped ends 17 are machined out of the material of the said sleeve. After the sleeve 3 has been slipped over the fastening section 5, the hook-shaped ends 17 engage in corresponding recesses 7 in the said fastening section of the pin contact 1 or socket contact 2 and give rise to twist-proofing in the radial direction.

In the course of the final assembly of the contact elements 1 and 2 in the receiving housings 24 and 25 respectively, the folded portions 16 of the spring flaps 15, which folded portions are bent virtually at right angles, latch into the particular contact chamber 26. Furthermore, the sleeve has a number of arresting flaps 21 and 22 which are machined out of the sheet-metal casing and with the aid of which the sleeve 3 is locked in position in the axial direction on the fastening section of the pin contact and socket contact.

Figure 5:
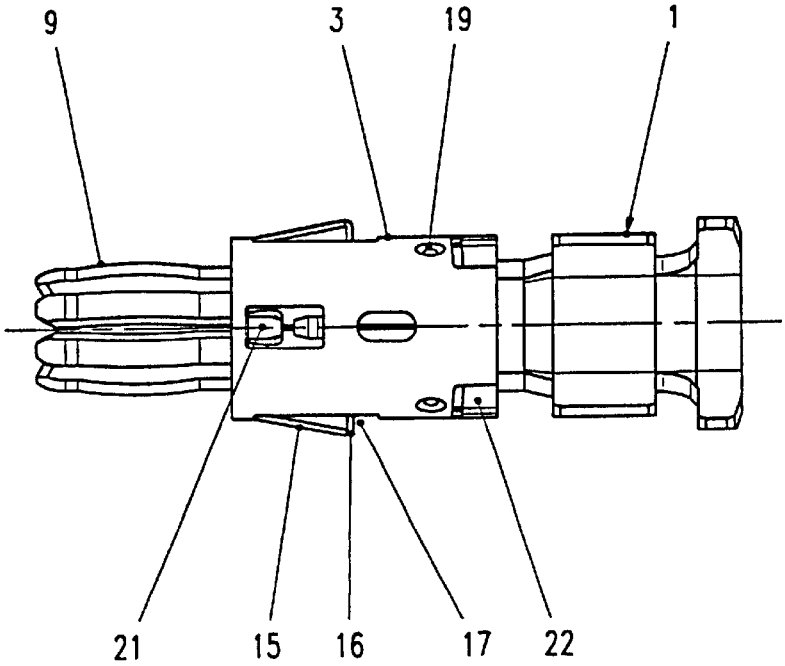
FIG. 5 shows a side view of a pin contact with an overlapping sleeve.

The pin contact is represented, with an overlapping sleeve 3, in FIG. 5 in a side view.

That contact-making section 4 of the pin contact 1 which is to be pushed into the socket contact 2 is spherically shaped and provided with a slightly rounded but open point, so that, on the one hand, easy introduction of the pin contact into the socket is guaranteed and also, on the other hand, reliable contact is made possible, even in the case of oblique plugging-in.

The spring flaps 15 protruding out of the sleeve 3 form, with their folded portions 16, latching elements which, when the contact element is pushed in, latch into the contact chambers 26 in the receiving housing and hold the contact element fast.

At the same time, the inwardly pointing, hook-shaped ends 17 of the spring flaps 15 protrude into bores or clearances 7 in the fastening section 5 and prevent radial twisting of the sleeve 3.

Furthermore, arresting flaps 21 and 22 for axially arresting the sleeve on the fastening section of the contact element are provided on either side of the end of the said sleeve.

Figure 6:
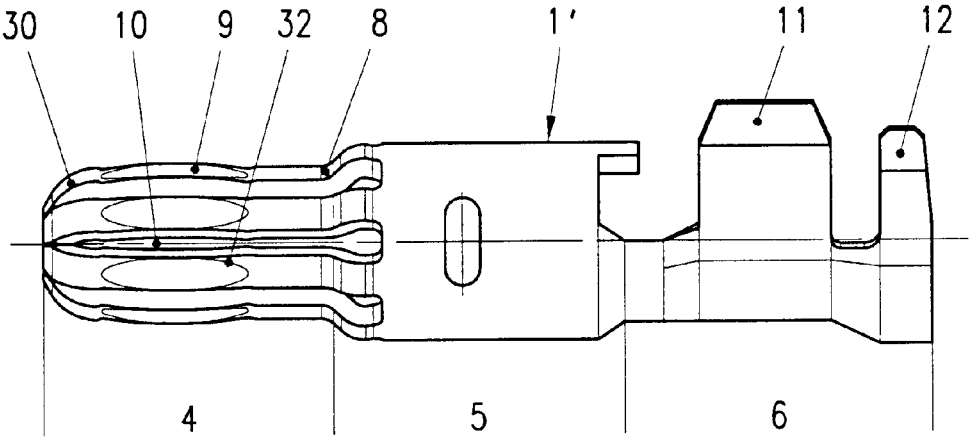
FIG. 6 shows a side view of a modified pin contact.

A modified pin contact 1' without an overlapping sleeve 3 is represented in FIG. 6 in a side view.

That contact section 4 of the pin contact 1' which is to be pushed into a socket contact—not shown here—is formed by the contact tongues 9 which are provided with outwardly directed embossed contact portions 32 and with a rounded point, so that easy introduction of the pin contact into the socket contact is guaranteed, and also reliable contact is made possible even in the case of oblique plugging-in.

In the front plugging-in region, the spherically arched contact tongues 9, which are separated from one another by slits 10, have a shape which is bent towards the central axis of the pin contact.

Under these circumstances, the points 30 of the contact tongues 9, which points are of trapezoidal construction, are kept spaced apart from one another laterally.

What is achieved as a result of this is that the initial plugging-in operation is facilitated by gentle resilience until the trapezoidal points 30 touch one another, as a result of which a heightened spring tension is obtained during the rest of the plugging-in operation. Under these circumstances, the spring characteristic of the contact tongues 9 fastened at one end in the tubular fastening section 5, which characteristic extends in a gentle manner at first, turns into a progressive, steep spring characteristic.

The progressive spring characteristic is brought about by the fact that the contact tongues abut at their two end points, namely in the fastening section 5 and also in the front plugging-in region, because of the trapezoidal points 30 which now touch each other, so that deformation remains possible only in the region of the contact tongues 9, which are shaped spherically outwards and are provided with elevated embossed portions 32.

Figure 7:
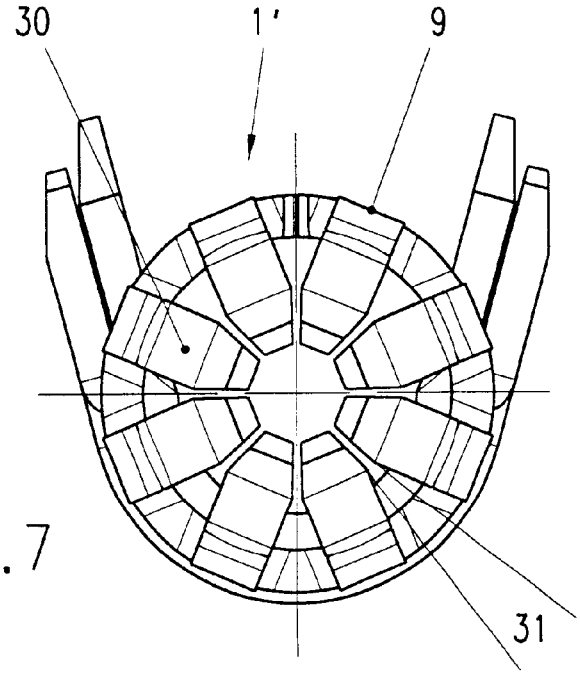
FIG. 7 shows a detail enlargement of the front end of the modified pin contact.

This embodiment of the contact tongues acts in such a way as to be self-centring and to compensate for possible circularity errors in the counterplug. FIG. 7 shows, in an enlarged representation, how the front ends 30 of the contact tongues 9, which front ends are disposed concentrically in relation to the centre point of the modified pin contact 1' and point towards one another in the shape of a star, are spaced apart from one another (distance 31) when in the condition in which they are not plugged in.

What is claimed is:

1. A contact element made of stamped and rolled sheet-metal material and having a contact-making section, a conductor-connecting section, and a fastening section for fastening the contact element in a receiving chamber in an insulating body, characterized in that there is pushed on, over the fastening section (5) of the contact element, a sleeve (3) which is disposed at a radial distance from said fastening section, said radial distance being set at a predetermined minimum separation distance between the sleeve (3) and the fastening section (5) to provide a permanent circulation of air and constant dissipation of heat between the sleeve (3) and the fastening section (5), characterized in that the sleeve (3) is provided with inwardly bent distance flaps (18) which are distributed over the periphery and by means of which the sleeve is centered on the fastening section (5).

2. The contact element according to claim 1, characterized in that the sleeve (3) is provided with inwardly directed impressed portions (19), by means of which the sleeve (3) is positioned centrally on the fastening section (5).

3. The contact element according to claim 1, characterized in that the contact element is constructed as a socket contact (2), the fastening section (5) of which is constructed for receiving a pin contact (1).

4. The contact element according to claim 3, characterized in that a crimping-type connecting region is provided on the conductor-connecting section (6).

5. A contact element made of stamped and rolled sheet-metal material and having a contact-making section, a conductor-connecting section, and a fastening section for fastening the contact element in a receiving chamber in an insulating body, characterized in that there is pushed on, over the fastening section (5) of the contact element, a sleeve (3) which is disposed at a radial distance from said fastening section, said radial distance being set at a predetermined minimum separation distance between the sleeve (3) and the fastening section (5) to provide a permanent circulation of air and constant dissipation of heat between the sleeve (3) and the fastening section (5), characterized in that inwardly directed arresting flaps (21, 22), by means of which the sleeve (3) is held on the fastening section (5) in such a way as to be secured against axial displacements, are constructed on the ends of said sleeve (3).

6. The contact element according to claim 5, characterized in that the sleeve (3) is provided with inwardly directed impressed portions (19), by means of which the sleeve (3) is positioned centrally on the fastening section (5).

7. The contact element according to claim 5, characterized in that the contact element is constructed as a socket contact (2), the fastening section (5) of which is constructed for receiving a pin contact (1).

8. The contact element according to claim 7, characterized in that a crimping-type connecting region is provided on the conductor-connecting section (6).

9. A contact element made of stamped and rolled sheet-metal material and having a contact-making section, a conductor-connecting section, and a fastening section for fastening the contact element in a receiving chamber in an insulating body, characterized in that there is pushed on, over the fastening section (5) of the contact element, a sleeve (3) which is disposed at a radial distance from said fastening section, said radial distance being set at a predetermined minimum separation distance between the sleeve (3) and the fastening section (5) to provide a permanent circulation of air and constant dissipation of heat between the sleeve (3) and the fastening section (5), characterized in that the sleeve (3) is provided with outwardly bent spring flaps (15), that inwardly directed folded portions (16) are formed on the spring flaps (15), and that hook-shaped ends (17) on the folded portions penetrate into clearances (7) in the fastening section (5) and secure the sleeve (3) against radial twisting.

10. The contact element according to claim 9, characterized in that the sleeve (3) is provided with inwardly directed impressed portions (19), by means of which the sleeve (3) is positioned centrally on the fastening section (5).

11. The contact element according to claim 9, characterized in that the contact element can be latched, by means of the outwardly bent spring flaps (15) on the sleeve (3), into a receiving chamber in an insulating body, the folded portions (16) of spring flaps (15) engaging behind latching shoulders in said receiving chamber.

12. The contact element according to claim 9, characterized in that the contact element is constructed as a socket contact (2), the fastening section (5) of which is constructed for receiving a pin contact (1).

13. The contact element according to claim 12, characterized in that a crimping-type connecting region is provided on the conductor-connecting section (6).

14. A contact element made of stamped and rolled sheet-metal material and having a contact-making section, a conductor-connecting section, and a fastening section for fastening the contact element in a receiving chamber in an insulating body, characterized in that there is pushed on, over the fastening section (5) of the contact element, a sleeve (3) which is disposed at a radial distance from said fastening section, said radial distance being set at a predetermined minimum separation distance between the sleeve (3) and the fastening section (5) to provide a permanent circulation of air and constant dissipation of heat between the sleeve (3) and the fastening section (5), characterized in that the contact element is constructed as a pin contact (1), the contact-making section (4) of which is formed by contact tongues (9) which are bent in a barrel-shaped manner and are separated by slits (10), that said slits (10) extend right into the fastening section (5), and that the contact tongues (9) are provided, immediately after the fastening section (5), with a constricted portion (8), the diameter of the contact-making section (4) being reduced compared with said fastening section (5), characterized in that outwardly pointing embossed portions (32) are raised up on the contact tongues (9), that the front ends (30) of said contact tongues (9) are bent radially towards the central axis of the pin contact (1) and, under these circumstances, point towards one another in the shape of a star, and that, in the condition in which they are not plugged into a socket contact, the front ends (30) of the contact tongues (9) are at a lateral distance (31) from one another.

15. The contact element according to claim 14, characterized in that the sleeve (3) is provided with inwardly directed impressed portions (19), by means of which the sleeve (3) is positioned centrally on the fastening section (5).

* * * * *